US006769560B1

(12) United States Patent
Lin

(10) Patent No.: US 6,769,560 B1
(45) Date of Patent: Aug. 3, 2004

(54) BOTTLE STOPPER

(76) Inventor: Ju-Chen Lin, No. 195, Sec. 3, Wenshin Rd., Beituen Chiu, Taichung (TW), 406

( * ) Notice: Subject to any disclaimer, the term of this patent is extended or adjusted under 35 U.S.C. 154(b) by 0 days.

(21) Appl. No.: 10/391,607

(22) Filed: Mar. 20, 2003

(51) Int. Cl.[7] ..... B65D 39/12
(52) U.S. Cl. ..... 215/361; 215/364; 220/238
(58) Field of Search ..... 215/355, 358, 215/359, 360, 361, 364; 220/234, 238

(56) References Cited

U.S. PATENT DOCUMENTS 1,283,347 A * 10/1918 Spelling ..... 215/40
3,091,358 A * 5/1963 Mac Simpkins ..... 220/238
3,338,447 A * 8/1967 Meyers, Jr. ..... 215/358
3,926,329 A * 12/1975 Guala ..... 215/361
4,621,743 A * 11/1986 DiRegolo et al. ..... 215/308
4,838,442 A * 6/1989 Merry ..... 215/228
5,117,995 A * 6/1992 Kau ..... 215/228
6,168,036 B1 * 1/2001 Teng ..... 215/296
6,536,618 B1 * 3/2003 Hwang et al. ..... 215/358
6,651,834 B2 * 11/2003 Wong ..... 215/260
6,719,160 B2 * 4/2004 Sen-Yih ..... 215/361

* cited by examiner

*Primary Examiner*—Nathan J. Newhouse
*Assistant Examiner*—James Smalley
(74) *Attorney, Agent, or Firm*—Bacon & Thomas PLLC

(57) ABSTRACT

A bottle stopper is constructed to include a stepped tubular stopper body, a split inner cap capped on a split bottom shank of the stopper body, a flexible outer cap capped on the inner cap, a press member mounted in the stopper body and movable between a first position where the press member gives no pressure to the inner cap and the outer cap and a second position where the press member forces the split bottom shank of the stopper body to stretch the inner cap and the outer cap radially outwards against the periphery of the bottle neck of the bottle in which the bottle stopper is inserted, and a return member adapted to return the press member from the second position to the first position after the stopper body been biased relative to the inner cap and the outer cap.

10 Claims, 7 Drawing Sheets

BOTTLE STOPPER

BACKGROUND OF THE INVENTION

1. Field of the Invention

The present invention relates generally to a bottle stopper and, more particularly, to such a bottle stopper that can be used repeatedly.

2. Description of the Related Art

When using a bottle to hold a liquid material it must be sealed with a cork or bottle cap, preventing direct contact of the liquid material with the outside air. If the bottle is not well sealed, the outside air-deteriorates the contained liquid material quickly. For example, glass bottles are commonly used to contain wine and sealed with a cork or bottle cap. The sealing status of a bottle directly affects the quality of the substance contained in the bottle.

However, if a bottle of wine is not drunk empty when opened, the cork or bottle cap must be fastened to the bottle again, preventing deterioration of contained wine. However, a metal bottle cap cannot be used again due to structural damage when removed from the bottle. If a bottle is sealed with a cork, the user may have to use a corkscrew to remove the cork from the bottle. When removed from the bottle by a corkscrew, the cork is damaged and cannot be used again to seal the bottle tightly.

It is therefore desirable to provide a bottle stopper that eliminates the aforesaid drawbacks.

SUMMARY OF THE INVENTION

The present invention has been accomplished under the circumstances in view. It is therefore the main object of the present invention to provide a bottle stopper, which can be used repeatedly to seal the bottle in an airtight status.

To achieve this object of the present invention, the bottle stopper comprises a hollow tubular stopper body a press member, a return member, an inner cap and a flexible outer cap. The stopper body has a receiving open chamber in an upper part thereof and a lower part formed of two symmetrical halves. The two symmetrical halves each have a protruding block and a stop edge. The press member is inserted into the stopper body and movable between a first position and a second position. The press member has a bottom end terminating in a stop portion and a front tip. The return member is mounted within the receiving open chamber of the stopper body around the press member and adapted to support the press member in the first position. The inner cap is capped on the lower part of the stopper body and rotatable relative to the stopper body. The inner cap has a plug hole in a bottom side of a split lower part thereof. The outer cap is capped on the inner cap. When the press member moved to the second position, the stop portion of the press member is stopped below the stop edges of the stopper body against the protruding blocks of the symmetrical halves of the stopper body to force the two symmetrical halves of the lower part of the stopper body bilaterally radially outwards, and the front tip of the press member is plugged into the plug hole of the inner cap to stretch the split lower part of the inner cap outwards. When the stopper body rotated relative to the inner cap through a predetermined angle, the stop edge is moved away from the stop portion of the press member, and the return member returns the press member to the first position, releasing stretching force from the outer cap.

DETAILED DESCRIPTION OF THE INVENTION

Figure 1:
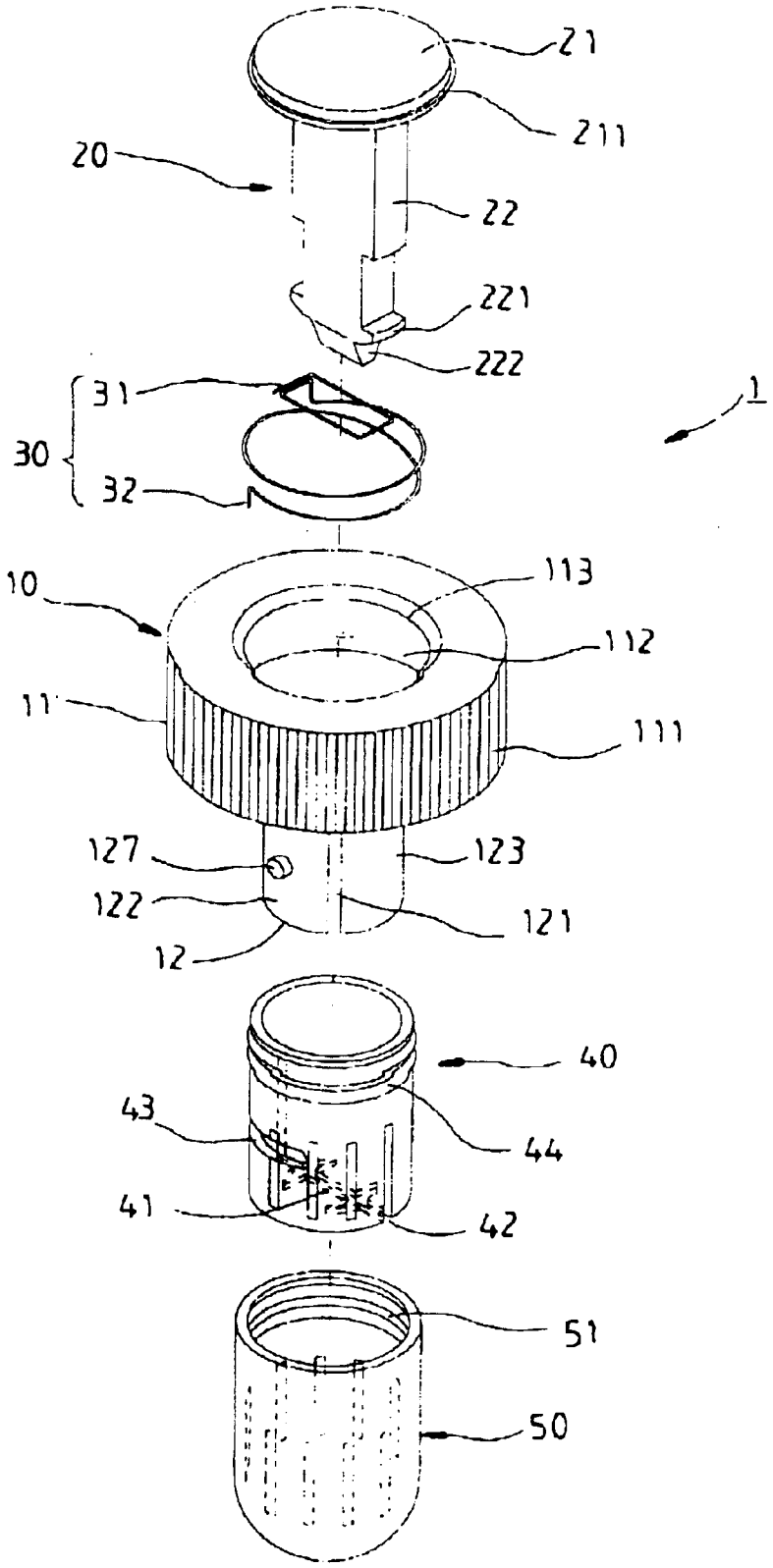
FIG. 1 is an exploded view of a bottle stopper according to a preferred embodiment of the present invention.
Figure 2:
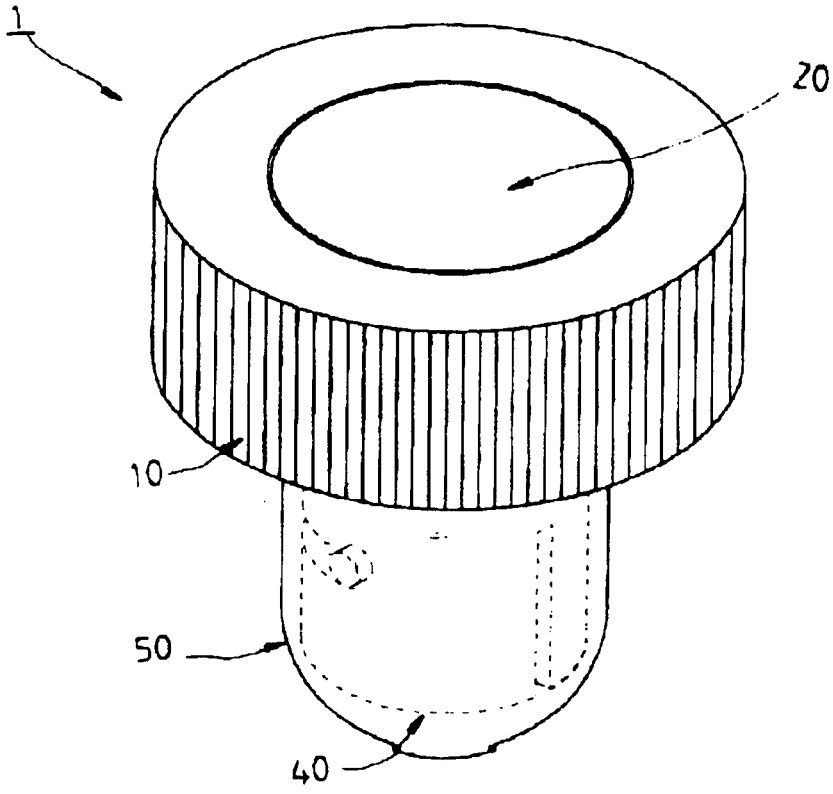
FIG. 2 is a perspective assembly view of the bottle stopper according to the preferred embodiment of the present invention.

Referring to FIGS. 1 and 2, a bottle stopper 1 is shown comprised of a stopper body 10, a press member 20, a return member 30, an inner cap 40, and an outer cap 50.

Figure 3:
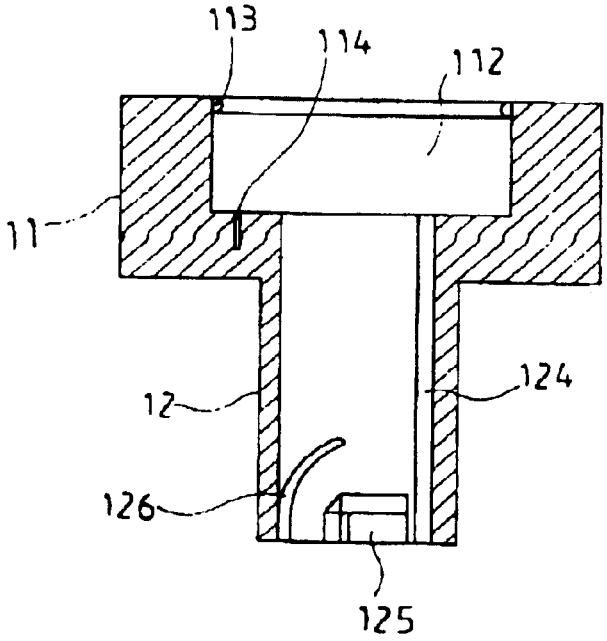
FIG. 3 is a side view in section of the stopper body for the bottle stopper according to the present invention.
Figure 4:
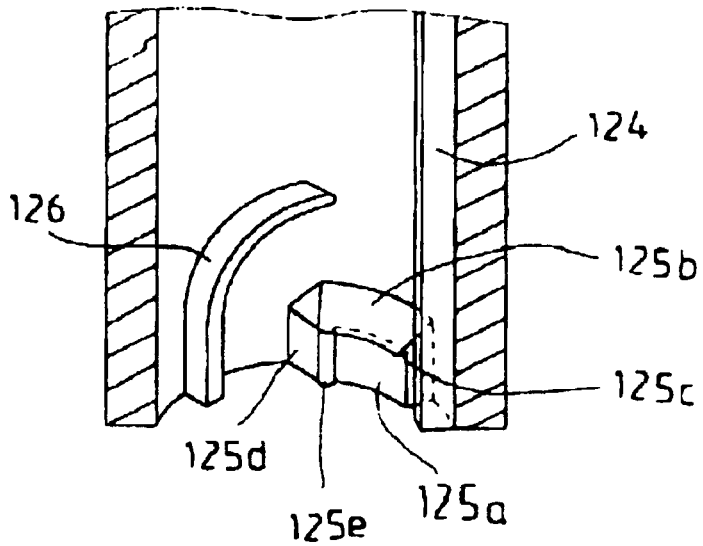
FIG. 4 is a sectional view of a part of the stopper body for the bottle stopper according to the present invention.

Referring to FIGS. 3 and 4 and FIGS. 1 and 2 again, the stopper body 10 is a substantially T-shaped tubular member having a head 11 at the top, a tubular shank 12 at the bottom, an embossed pattern 111 around the periphery of the head 11, a circular receiving opening chamber 112 in the top of the head 11, an inside annular flange 113 radially inwardly projecting from the periphery of the circular receiving open chamber 112 at the top side, and a plug hole 114 in the bottom of the receiving open chamber 112. The tubular shank 12 comprises two symmetrical halves, namely, the left half 122 and the right half 123 separated by a longitudinal crevice 121. The two symmetrical halves 122 and 123 each have a longitudinal guide rail 124 extended along the longitudinal crevice 121 from the bottom side to the receiving open chamber 112, a protruding block 125 projecting from the inside wall at the bottom side, and an arched guide rib 126 protruding from the inside wall and spaced from the protruding block 125 at one side opposite to the longitudinal guide rail 124. The left half 122 further comprises a guide peg 127 projecting from the periphery.

The protruding block 125 comprises a main body 125*a*, a first sloping face 125*b* at one side of the main body 125*a*, a hooked stop edge 125*c* at the connecting area between the main body 125*a* and the first sloping face 125*b*, a second sloping face 125*d* extended from the smoothly arched inside wall of the respective half 122 or 123 and abutted against the first sloping face 125*b*, and a step 125*e* connected between the second sloping face 125*d* and the main body 125*a*. The arched guide rib 126 is spaced from the protruding block 125 at a distance. The top end of the arched guide rid 126 is suspended above the protruding block 125 corresponding to the step 125*e*.

Figure 8:
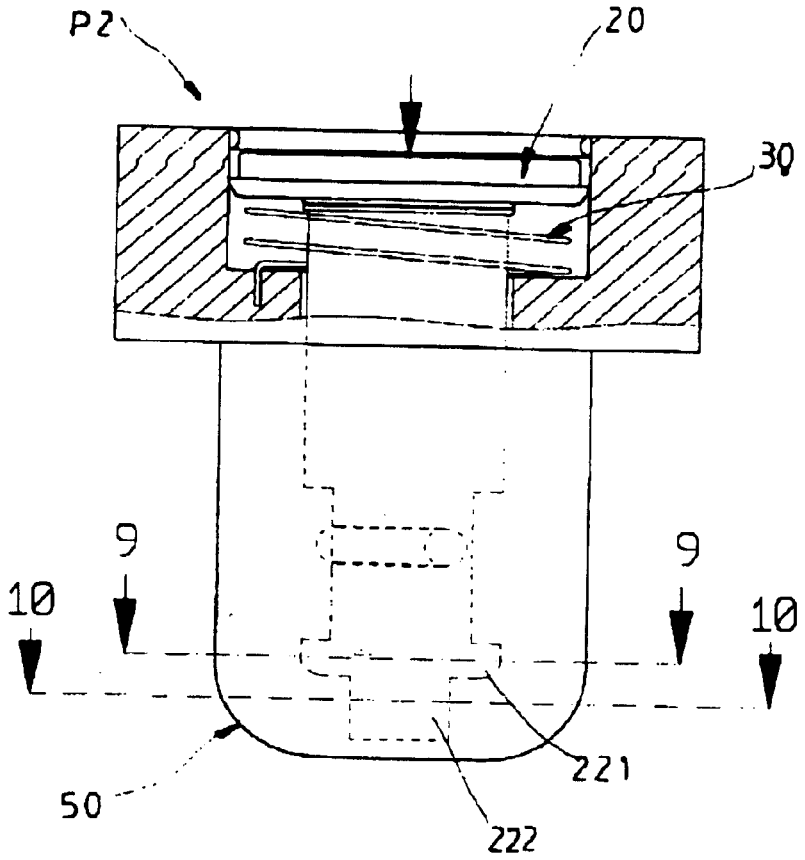
FIG. 8 is another side view, partially in section, of the bottle stopper according to the present invention, showing the second position status of the press member.

Referring to FIGS. 1 and 2 again, the press member 20 is inserted into the receiving open chamber 112 of the stopper body 10, and moved between the first position P1 (see also FIG. 5) and the second position P2 (see also FIG. 8), comprising a disk-like press head 21 and a flat shank body 22 perpendicularly extended from the bottom side of the press head 21. The press head 21 has a flange 211 extended around the periphery. The maximum outer diameter of the press head 21 is slightly smaller than the inner diameter of the receiving open chamber 112 so that the press head 21 can be received in the receiving open chamber 112. The shank body 22 is a flat elongated stepped member inserted through the receiving open chamber 112 into the inside of the shank 12 of the stopper body 10, having a rectangular cross section, a bilaterally outwardly protruded stop portion 221, and a double-beveled front tip 222 downwardly extended from the bottom side of the stop portion 221. The width of the stop portion 221 is passable through the gap between the guide rib 126 and the second sloping face 125*d*.

Figure 5:
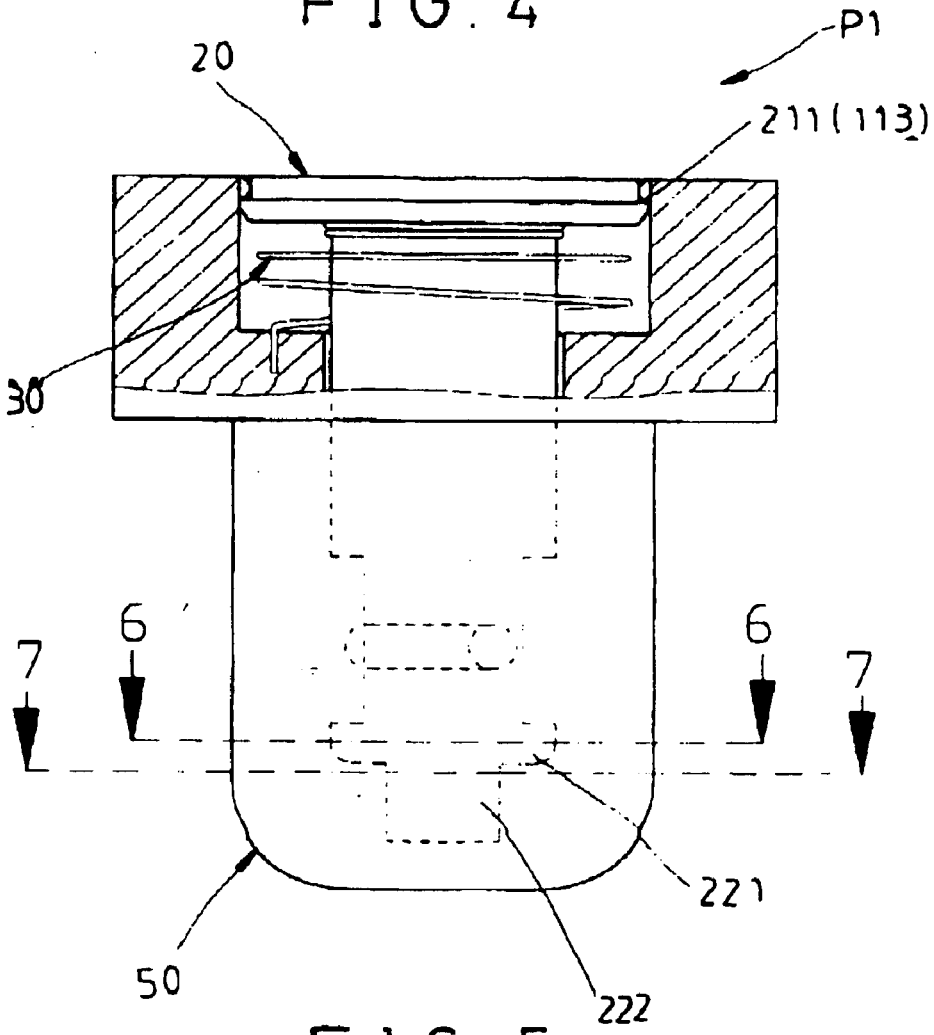
FIG. 5 is a side view, partially in section, of the bottle stopper according to the present invention, showing the first position status of the press member.

Referring to FIG. 5 and FIG. 1 again, the return member 30 is a return spring mounted within the receiving open chamber 112 of the stopper body 10 around the press member 20, having a top end terminating in a rectangular frame 31, which is sleeved onto the shank body 22 of the press member 20, and a bottom end terminating in a plug tip 32, which is plugged into the plug hole 114 of the stopper body 10.

Referring to FIGS. 1 and 2 again, the inner cap 40 is a hollow cylindrical member sleeved onto the shank 12 of the stopper body 10, having a bottom plug hole 41 in the bottom wall, two elongated crevices 42 longitudinally upwardly extended from two ends of the bottom plug hole 41, a guide slot 43 transversely extended around the periphery, and antiskid threads 44 around the periphery.

Referring to FIGS. 1 and 2 again, the outer cap 50 is a flexible cap capped on the inner cap 40 and insertable into the bottle neck of a bottle, having antiskid threads 51 extended around the inside wall and adapted to engage the antiskid threads 44 of the inner cap 40.

Figure 6:
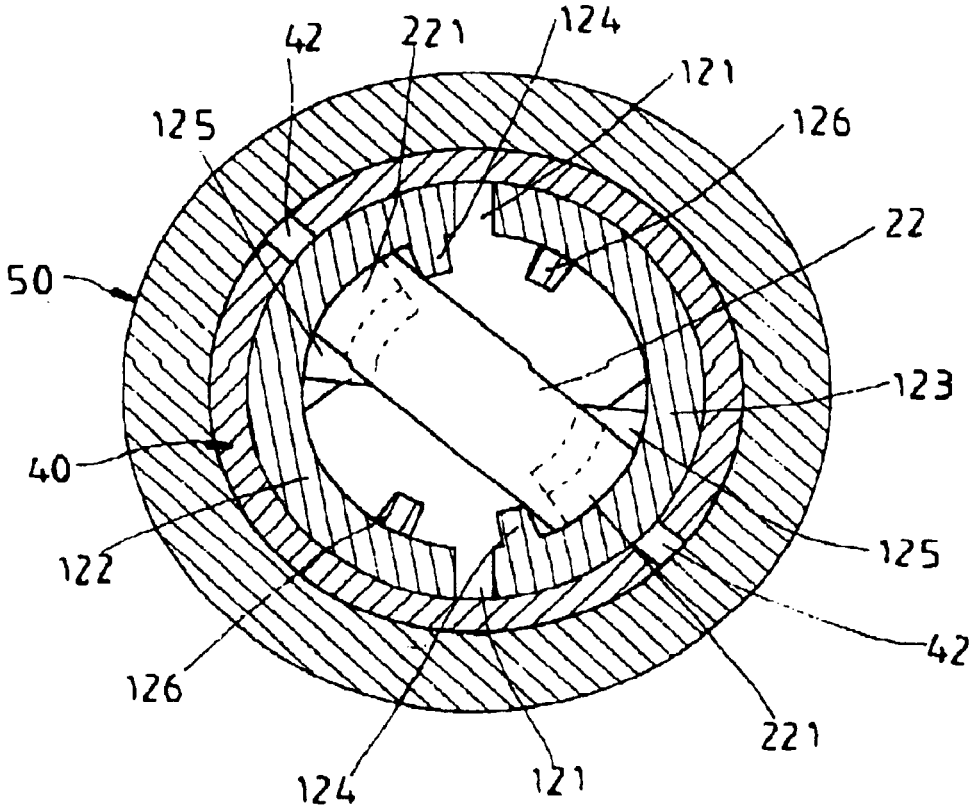
FIG. 6 is a sectional view taken along line 6—6 of FIG. 5 showing the two symmetrical halves of the stopper body not stretched.

The installation and use of the bottle stopper 1 are described hereinafter. During assembly process, the inner cap 40 is capped on the shank 12 of the stopper body 10. Because the two symmetrical halves 122 and 123 are radially inwardly compressible, the shank 12 of the stopper body 10 can easily be inserted into the inner cap 40 to suspend the guide peg 127 in the guide slot 43, for enabling the stopper body 10 to be rotated relative to the inner cap 40 within a predetermined angle. Thereafter, the return member 30 is put in the receiving open chamber 112 of the stopper body 10, enabling the plug tip 32 to be plugged into the plug hole 114, and then the shank body 22 of the press member 20 is inserted through the frame 31 of the return member 30 and transversely supported between the longitudinal guide rails 124 of the two symmetrical halves 122 and 123 of the shank 12 of the stopper body 10 (see FIG. 6), and then press the press head 21 to force the flange 211 of the press head 21 downwards over the inside annular flange 113 of the stopper body 10, keeping the flange 211 stopped below the inside annular flange 113 of the stopper body 10, and then the outer cap 50 is capped on the inner cap 40 to complete the assembly (see FIG. 2). When assembled, the return member 30 imparts a torsional force in one direction, keeping the two opposite lateral sides of the press member 20 positively stopped at the longitudinal guide rails 124 of the shank 12 of the stopper body 10.

Figure 7:
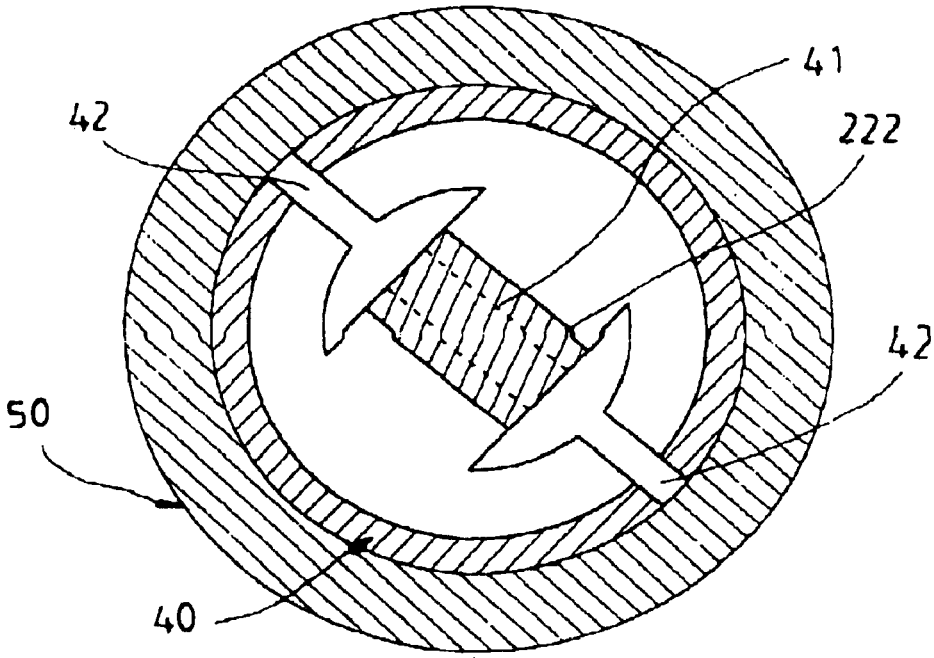
FIG. 7 is a sectional view taken along line 7—7 of FIG. 5, showing the inner cap not stretched.

When the bottle stopper 1 assembled, the return member 30 supports the press member 20 in the first position P1 (see FIG. 5), where the stop portion 221 of the press member 20 is disposed above the protruding blocks 125 of the two symmetrical halves 122 and 123 of the shank 12 of the stopper body 10 (see FIG. 6), and the front tip 222 of the press member 20 is not inserted into the plug hole 41 of the inner cap 40 (as shown in FIG. 7, in which the stopper body is now shown), i.e., the outer cap 50 is not stretched to deform.

Figure 9:
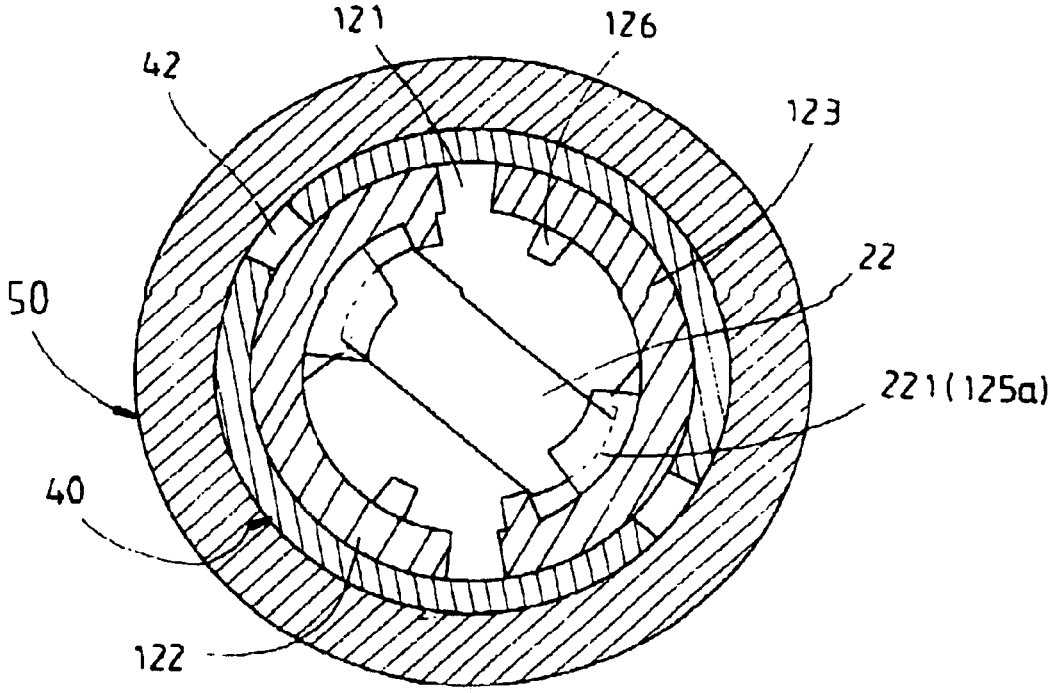
FIG. 9 is a sectional view taken along line 9—9 of FIG. 8 showing the second position status of the press member.

Referring to FIGS. from 8 through 10, when pressing the press member 20 from the first position P1 to the second position P2, the press member 20 is lowered along the guide rails 124, and the stop portion 221 is moved to the first sloping faces 125*b* of the protruding blocks 125 of the two symmetrical halves 122 and 123 of the shank 12 of the stopper body 10 to force the two symmetrical halves 122 and 123 bilaterally outwards (see FIG. 9), i.e., to expand the width of the crevice 121, resulting in a primary stretching action at the outer cap 50. Due to the effect of the upward push force of the return spring 30, the top side of the stop portion 221 of the press member 20 is stopped below the hooked stop edges 125*c* of the protruding blocks 125 of the two symmetrical halves 122 and 123 of the shank 12 of the stopper body 10, and the lateral sides of the stop portion 221 are stopped against the steps 125*c* of the protruding blocks 125, keeping the stretching status in action.

Figure 10:
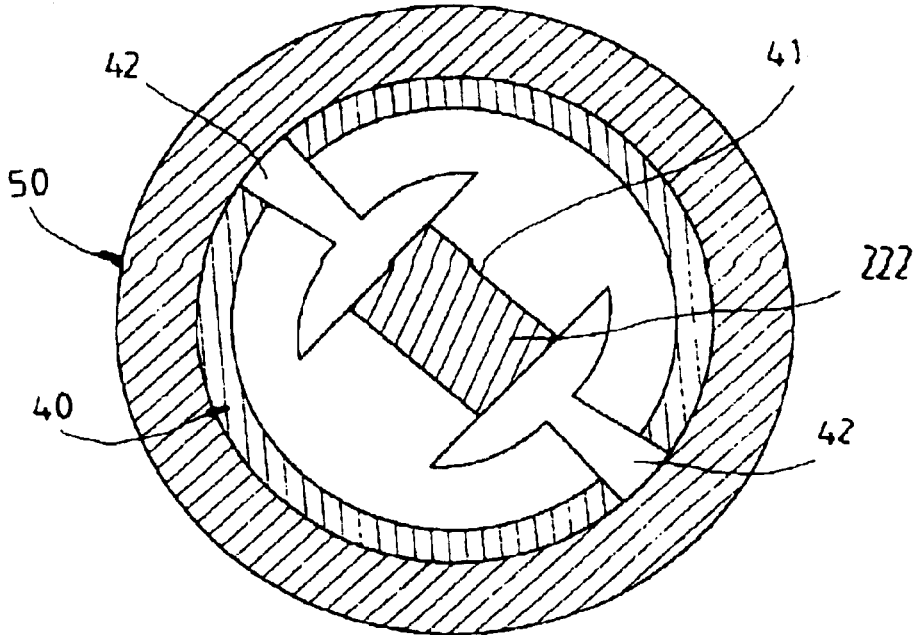
FIG. 10 is a sectional view taken along line 10—10 of FIG. 8 showing the inner cap stretched.

When the double-beveled front tip 222 of the press member 20 inserted into the narrow plug hole 41 as shown in FIG. 10, the press member 20 is prohibited from rotary motion, and the peripheral wall of the inner cap 40 is bilaterally outwardly stretched to expand the crevice 42, giving a secondary stretching effect to the outer cap 50. Therefore, when pressing the press member 20 after insertion of the bottle stopper 1 into the bottleneck of a bottle, the outer cap 50 is stretched by the aforesaid primary and secondary stretching effects in different directions to seal the bottleneck of the bottle.

Figure 12:
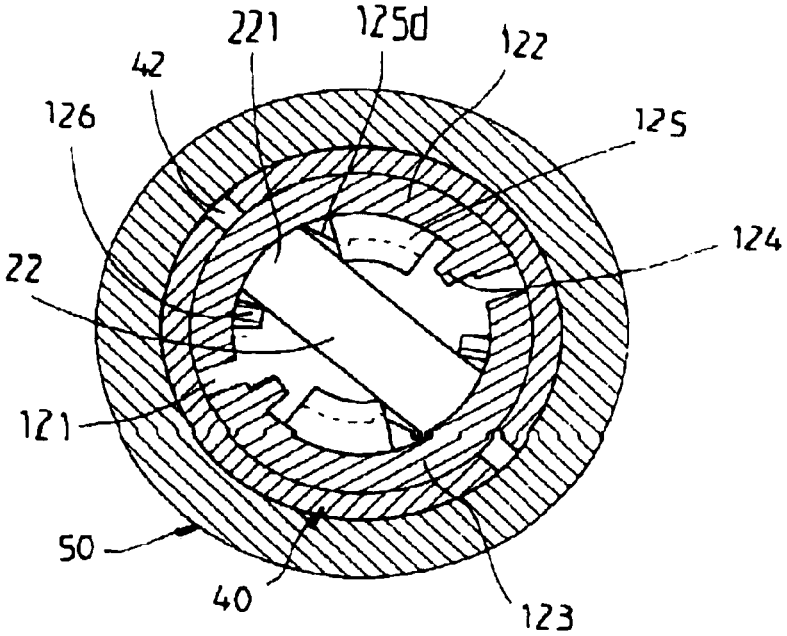
FIG. 12 is a cross sectional view of the present invention showing the relative positioning between the press member and the stopper body after rotation of the stopper body.
Figure 11:
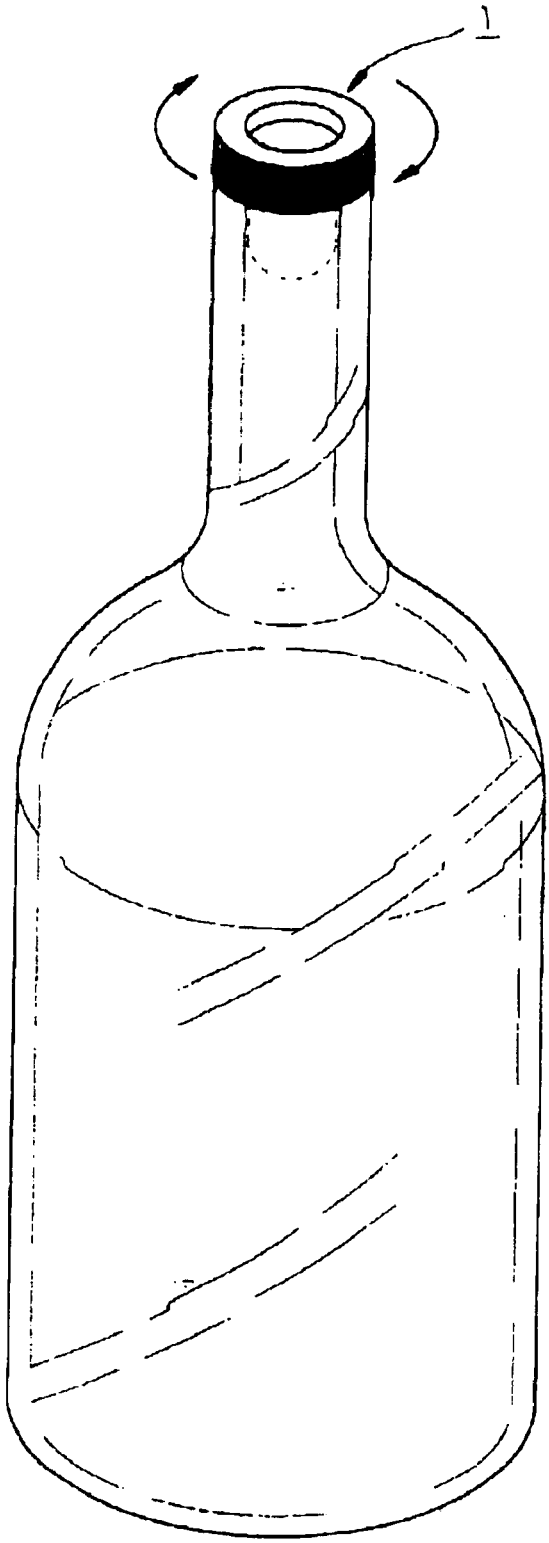
FIG. 11 is an applied view of the present invention, showing the bottle stopper fastened to the bottleneck of a bottle and the stopper body rotated.

Referring to FIGS. 11 and 12, when wishing to remove the bottle stopper 1 from the bottle, rotate the stopper body 10 in one direction relative to the inner cap 40 and the press member 20 to move the stop portion 221 along the second sloping faces 125*d* of the two symmetrical halves 122 and 123 of the shank 12 of the stopper body 10 into the gap between the arched guide rib 126 and second sloping face 125*d* of each half 122 and 123 of the shank 12 of the stopper body 10. At this time, the stop portion 221 is disconnected from the hooked stop edges 125*c* of the protruding blocks 125 of the two symmetrical halves 122 and 123 of the shank 12 of the stopper body 10, and the return member 30 pushes the press member 20 from the second position P2 back to the first position P1. During up stroke of the press member 20, the stop portion 221 is forced against the arched guide ribs 126 of the protruding blocks 125 of the two symmetrical halves 122 and 123 of the shank 12 of the stopper body 10 thereby causing the stopper body 10 to be biased horizontally through an angle till the longitudinal guide rails 124 touch the shank body 22 of the press member 20 again. When the press member 20 returned to the first position P1, the stretching force is disappeared, and the outer cap 50 returns to its former shape, enabling the bottle stopper 1 to be removed from the bottleneck of the bottle.

As indicated above, the bottle stopper 1 can be plugged into the bottleneck of the bottle again when opened and the bottle stopper 1 seals the bottle tightly when the user pressed the press member 20. Therefore, the bottle stopper 1 can be used repeatedly without lowering its sealing power.

What is claimed is:

1. A bottle stopper comprising:

a hollow tubular stopper body having a receiving open chamber in an upper part thereof and a lower part formed of two symmetrical halves separated by a crevice, said two symmetrical halves each having a protruding block and a stop edge;

a press member inserted into said stopper body and movable between a first position and a second position said press member having a bottom end terminating in a stop portion and a front tip;

a return member mounted within said receiving open chamber of said stopper body around said press member and adapted to support said press member in said first position;

an inner cap capped on the lower part of said stopper body and rotatable relative to said stopper body, said inner cap having a plug hole in a bottom side of a split lower part thereof; and a flexible outer cap capped on said inner cap;

wherein when said press member moved to said second position, the stop portion of said press member is stopped below the stop edges of said stopper body against the protruding blocks of the symmetrical halves of said stopper body to force the two symmetrical halves of the lower part of said stopper body bilaterally radially outwards, and the front tip of said press member is plugged into the plug hole of said inner cap to stretch the split lower part of said inner cap outwards; when said stopper body rotated relative to said inner cap through a predetermined angle, the stop edge is moved away from the stop portion of said press member, and said return member returns said press member to said first position, releasing stretching force from said outer cap.

2. The bottle stopper as claimed in claim 1, wherein said stopper body comprises a head forming the upper part and a tubular shank forming the lower part, said head defining said receiving open chamber in a top side thereof, said tubular shank having the crevice separating said tubular shank into said two symmetrical halves.

3. The bottle stopper as claimed in claim 2, wherein the protruding block of each of the two symmetrical halves of the lower part of said stopper body comprises a main body, a first sloping face at one side of said main body, said first sloping face having a lower part terminating in said stop edge.

4. The bottle stopper as claimed in claim 3, wherein said press member comprises a disk-like press head and a shank body, said press head being received in the receiving open chamber of the head of said stopper body, said shank body being extended from said press head and inserted into the shank of said stopper body, said shank body having a bottom end terminating in said stop portion and said front tip, said stop portion being moved along the first sloping faces of the protruding blocks of the two symmetrical halves of the lower part of said stopper body to the main bodies of the protruding blocks of the two symmetrical halves of the lower part of said stopper body to stretch the two symmetrical halves of the lower part of said stopper body bilaterally outwards when said press member moved from said first position to said second position, said front tip being double-beveled and adapted to stop said press member from rotation relative to said stopper body when plugged into the plug hole of said inner cap.

5. The bottle stopper as claimed in claim 4, wherein the two symmetrical halves of the lower part of said stopper body each have a longitudinally extended guide rail; the shank body of said press member is supported between the longitudinal guide rails of the two symmetrical halves of the lower part of said stopper body when said stopper body not rotated, enabling the stop portion of said press member to be moved to the main bodies of the protruding blocks of the two symmetrical halves of the lower part of said stopper body when said press member moved from said first position to said second position.

6. The bottle stopper as claimed in claim 5, wherein the two symmetrical halves of the lower part of said stopper body each have an arched guide rib; the protruding block of each of the two symmetrical halves of the lower part of said stopper body comprises a second sloping face abutted against the respective first sloping face; when said stopper body biased through an angle relative to said inner cap and said press member, the stop portion of said press member is moved with said press member away from the stop edge of the protruding block of each of the two symmetrical halves of the lower part of said stopper body along the second sloping faces of the two symmetrical halves of the lower part of said stopper body into the gap between the second sloping face and arched guide rib of each of the two symmetrical halves of the lower part of said stopper body, enabling said press member to be moved upwards along the arched guide ribs of the two symmetrical halves of the lower part of said stopper body and back to said second position by said return member where the longitudinal guide rails of the two symmetrical halves of the lower part of said stopper body touch said press member.

7. The bottle stopper as claimed in claim 4, wherein said disk-like head of said press member has a flange extended around the periphery thereof; said stopper body has an inside annular flange radially inwardly projecting from the periphery of said circular receiving open chamber at a top side and adapted to stop the flange of the disk-like head of said press member inside the receiving open chamber of said stopper body.

8. The bottle stopper as claimed in claim 1, wherein said inner cap has a transversely extended guide slot; said stopper body has a guide peg projecting from the periphery thereof and inserted into the guide slot of said inner cap and adapted to guide rotary motion of said stopper body relative to said inner cap within a predetermined angle.

9. The bottle stopper as claimed in claim 1, wherein said inner cap has elongated crevices longitudinally upwardly extended from two ends of the plug hole of said inner cap.

10. The bottle stopper as claimed in claim 1, wherein said return member is a compression spring, said compression spring having one end fixedly fastened to a part inside the receiving open chamber of said stopper body and an opposite end fastened to said press member.

* * * * *